US006789972B2

(12) United States Patent
Nadel

(10) Patent No.: US 6,789,972 B2
(45) Date of Patent: Sep. 14, 2004

(54) ILLUMINABLE WAND-TYPE APPLICATOR

(76) Inventor: Craig P. Nadel, 20 Tomalyn Hill Rd., Montville, NJ (US) 07045

( * ) Notice: Subject to any disclaimer, the term of this patent is extended or adjusted under 35 U.S.C. 154(b) by 0 days.

(21) Appl. No.: 10/156,523

(22) Filed: May 28, 2002

(65) Prior Publication Data

US 2002/0172543 A1 Nov. 21, 2002

Related U.S. Application Data

(63) Continuation of application No. 09/956,678, filed on Sep. 20, 2001, now abandoned.
(60) Provisional application No. 60/233,886, filed on Sep. 20, 2000.

(51) Int. Cl.[7] ..... B43K 29/00; A46B 11/00; F21V 33/00

(52) U.S. Cl. ..... 401/195; 401/126; 401/130; 362/96; 362/101; 362/119

(58) Field of Search ..... 401/126, 195, 401/52, 124, 130, 118, 194; 362/119, 120, 101, 96, 108; 132/317

(56) References Cited

U.S. PATENT DOCUMENTS

| | | | | |
|---|---|---|---|---|
| 2,269,750 A | * | 1/1942 | Baird | 240/6.46 |
| 3,655,960 A | * | 4/1972 | Andree | 240/6.46 |
| 4,888,667 A | * | 12/1989 | Hwang | 360/109 |
| 4,988,354 A | * | 1/1991 | Locke | 606/133 |

* cited by examiner

*Primary Examiner*—David J. Walczak
(74) *Attorney, Agent, or Firm*—Cohen, Pontani, Lieberman & Pavane

(57) ABSTRACT

A wand-type applicator for liquid cosmetic material includes a first housing part carrying an elongated wand of light-transmissive material with a fixed end mounted in or to the housing part and projecting outwardly therefrom to a free end remote from the housing part. The free end carries a pad of absorbent material or other structure for retaining a cosmetic liquid stored or contained in a reservoir in a second housing part which is formed as a vial that is disengageably matable with the first housing part. A selectively-activatable light source such as an LED and an associated power source is mounted in the first housing part so that light emitted from the activated LED enters the fixed end of the wand and diffuses through the wand toward its surface, to thereby illuminate the wand from the interior thereof.

19 Claims, 1 Drawing Sheet

ILLUMINABLE WAND-TYPE APPLICATOR

RELATED APPLICATIONS

This application claims priority from U.S. Provisional Patent Application Serial No. 60/233,886, which was filed on Sep. 20, 2000 and is a continuation of U.S. patent application Ser. No. 09/956,678 filed Sep. 20, 2001 now abandon.

BACKGROUND OF THE INVENTION

1. Field of the Invention

The present invention is directed to internally illuminated devices, and more particularly to a selectively or operatively illuminable wand-type applicator for lip gloss or coloring, eye shadow, body paint or other cosmetic materials that are applied to a user's body.

The invention is herein described, by way of illustration, with respect to an embodiment that provides a handheld applicator for manually applying lip gloss to a user's lips, but it is equally applicable to other, related or analogous uses—for example to apply tints or colorings or paints or other liquid-form materials to portions of a user's body—with little or no modification. Indeed, those skilled in the art will recognize that the inventive device and arrangement as herein disclosed may be additionally modified or utilized to apply non-cosmetic materials, such as colorants and adhesives and the like, to inanimate work surfaces. Moreover, the use herein of the term "liquid" is intended to include materials having a wide range of viscosities, from those that flow as freely as water to relatively thick pastes or gels.

2. Description of Related Art

Wand-type lip gloss applicators, as heretofore known and readily available, are generally configured as elongated, cylindrical, two-piece housings in which the two mating housing parts are manually separable to reveal an elongated rod or wand that is secured or anchored to and projects outward from a first one of the housing parts. The rod carries, on its free end opposite that end of the rod which is anchored to the first housing, a mass or pad or wad of an absorbent or semi-absorbent material for receiving and temporarily retaining thereon the liquid-form lip gloss material for transfer from the material to the user's lips. The absorbent or semi-absorbent mass may, by way of illustrative example, be formed of a foam pad commonly used for such purposes and that encircles the free end of the rod.

The second housing part forms a cover for the first housing part and the two parts are releasably engageable and disengageable, as for example by snap-fit engagement or by relative threaded rotation therebetween, to respectively protectively cover and enclose the wand during periods of nonuse, on the one hand, and to separate the housing halves and thereby provide access to the wand for user-manipulation of the first housing part to apply lip gloss to the user's lips, on the other. The second housing part may enclose a reservoir for the lip gloss or other liquid-form material to be applied to the body or work surface so that, when the housing halves are interengaged with the wand enclosed within the cover, at least the mass-carrying free end of the rod or wand is immersed in or otherwise in contact with liquid material from the reservoir. Thus the first part of the housing—i.e. that carrying the outwardly-projecting wand—is graspable and selectively manipulable by the user to place or "dip" the wand free end into the cover-containing liquid reservoir (or to at least disengage the cover from the wand-carrying housing part when the applicator has been in its storage condition) and to then position and move the free or outward end of the wand, which carries the liquid-retaining mass of material, against and along the user's lips to apply the liquid to the lips.

SUMMARY OF THE INVENTION

A wand-type applicator in accordance with the present invention retains this general configuration or form and its operative utility and functionality. In addition, however, the invention provides structure and elements that illuminate the wand in response to one or more various alternative forms of activation.

According to the invention, a wand of light transmissive or transmitting material has a fixed end mounted in a first housing part and projecting from the fixed end to a free end remote from the housing part. The free end has or carries a means for retaining a liquid, such as a mass or pad of absorbent material, which liquid may be contained in a second housing part which mates with the first housing part. The first housing part has mounted therein a light source which is mounted so that light emitted therefrom enters the fixed end of the wand, as well as a power source and a switch. In preferred forms of the invention, the light source includes a light emitting diode (LED), such as one operable to generate a red or other color or uncolored light, and the power source may comprise one or a plurality of conventional button-type or otherwise miniaturized batteries to power the LED.

When the LED is activated, in accordance with the invention the emitted light illuminates the wand from the interior thereof. Toward that end, the wand is formed of a predeterminately light-transmissive material, such as plastic, and may be transparent or translucent to provide a predetermined amount of diffused light along and through the wand and onto its surface. By suitable selection of the wand material—the particular material being a general matter of design choice, within the knowledge and abilities of the person of ordinary skill in the art, to suit the particular degree and variety and related aspects of the illumination of the wand that are desired—the light from the LED is received by and passes through and along the length of the wand so as to illuminate the surface of the wand, preferably along its entire length, so that the internally illuminated wand is readily visible to the user. It is also intended that the free end of the wand be sufficiently illuminated by the light emitted by the LED so that the liquid-retaining mass or pad carried on its free end is at least partly illuminated for ready viewing of, for example, any desired special effects. Toward that end, the end of the wand about which the pad or mass is carried may be predeterminately shaped or scored to provide particular illumination-related or enhancing visual effects to, or visible through, the surrounding pad. In addition, the material forming the liquid-retaining pad or mass may be selected with a suitable degree of transparency or translucence, and/or may have patterns or designs defined in the pad and/or in all or a portion of the free end of the wand about which the mass or pad is carried. This functionality may also or alternatively be implemented or enhanced in any of various ways within the scope and contemplation of the invention. For example, to provide or enhance illumination of the wand, it may be formed to include a fluorescing or phosphorescing or other illumination-effecting or enhancing additive, and/or reflecting materials or particles such as glitter. The LED may be selected to transmit at higher frequencies including the ultraviolet range in order to stimulate the phosphors in the wand to emit predetermined visible wavelengths. The translucence of the liquid to be applied by the wand applicator may also be selected to enhance the operating effect of the inventive applicator, including the inclusion of fluorescing or light-conduction-assisting or enhancing additives in or to the liquid.

In one contemplated implementation, the fixed end of the wand is located immediately adjacent, or at least closely proximate, the LED, so that when the LED is activated the resulting light readily impinges on and is received by the fixed end of the wand and is passed or transmitted and diffused down and along the length of the wand so as to impart a user-visible "glow" or illumination to the surface of the wand. Transmission of light from the illuminated LED to the fixed end of the wand may, optionally, be enhanced or facilitated by placing or positioning a lens or other light-conducting surface—for example a circular collector plate against or in substantial contact with or formed as a unitary part of the wand end between the wand end and the adjacent LED. Alternatively, any other configuration or structure or arrangement of directing light from the illuminated LED into the rod or wand may also be employed, such for example as by mounting the LED in a partially-surrounding cup or bowl or conical or frustoconical light-funneling member (to which the rod may be integrally attached) to maximize the capture of light from the LED and direct the captured light into the rod. Alternatively or additionally, a reflector may be provided around the base of the LED in order to reflect light toward the wand.

The rod, instead of having a single, constant diameter—or, as shown in the attached drawing, a regularly-decreasing diameter—along its length may in modified implementations bear one or more radially-extending projections or irregularities or other diametric variations predeterminately-defined along its length for carrying illumination through and along those projections, thereby providing a varied pattern of illumination at those locations.

The invention contemplates that the LED may be activated to emit light into the wand in any one or more of various ways, only a representative sampling of which are herein described by way of illustrative example. In one embodiment, a spring-loaded push-to-operate switch selectively actuable by the user is located on the wand-carrying housing part—preferably on the housing part periphery at the position at which the user typically grasps the first housing part to manipulate and thereby apply lip gloss or other liquid-form material from the wand pad or mass to the user's lips. In this way, the wand can be readily illuminated by the user when holding the wand-carrying housing part and/or when applying lip gloss to the lips, as for example by applying inwardly-directed pressure to a deformable or movable section of the housing wall or against an activating button of the switch disposed in and/or through the wall. The switch may be implemented by extending a bent wire leg of the LED to define a spring-loaded return mechanism for a switch button, or by utilizing a separate electrically-conductive element that is disposed between the LED and switch button, or by mounting a conventional spring-loaded push-button switch device in or on or to or adjacent the housing wall, or in any other suitable manner to provide the desired functionality.

In another contemplated embodiment, or as an addition to another actuation implementation, a pressure-sensitive switch may be incorporated within the housing so that, when the wand is pressed with suitable pressure against the user's lips to apply lip gloss to the lips, the side-to-side (lateral) or end-exerted (longitudinal) pressure on the free end of the wand activates the pressure-sensitive switch to cause the wand to illuminate or "glow".

In yet another implementation, or as a further addition to another of the described or contemplated embodiments, a switch activated by a change in orientation of the wand-carrying housing—such as what is sometimes referred to as a "shake-to-actuate" switch—can be provided so that the wand is illuminated randomly or otherwise in response to movement or shaking of the housing. Such an arrangement may optionally be augmented by suitable structure or elements to prevent motion-initiated illumination of the LED when the housing is closed, or to otherwise disable this feature so that the LED will not be unintentionally activated during periods of storage or nonuse, such as when the closed housing is being carried or transported on a user's person or within a handbag or carrying case.

The inventive applicator may also be provided with timing circuitry or the like so that, whenever activated, the LED will continue to emit light (by continued application of power thereto) for a predetermined or randomly (or otherwise varying) period of time beyond the termination of the cause of the initial activation. In such an implementation—or indeed in any other(s) of the herein described or contemplated embodiments—it is also within the intended scope of the invention that the LED, instead of continuously emitting light in response to activation, may flash or pulse at a single or a varying rate.

It is also intended that the second housing part, i.e. the removable "cover" of the housing that typically forms the reservoir for the lip gloss liquid—may be formed in whole or part of a transparent or translucent material to provide exterior visibility of the wand, through the cover wall, and optionally through the liquid in the reservoir as well. Such an embodiment can provide an attractively subdued illumination of the second housing part. Similarly, the housing cover may be "patterned", as for example with design or pattern-forming grooves or indentations or relief patterns, which will receive light from the wand and thereby define an attractive illuminated pattern on the housing cover which the user can view.

In yet another contemplated implementation of the inventive applicator, the wand may exclude the absorbent or semi-absorbent liquid-retaining pad or mass hereinabove described. Instead, the free end of the wand may be configured to retain a sufficient quantity of liquid for selective application to the user's body or to a work surface. For example, the free end may be configured to form a substantially flat or contoured spatula. The specially-configured or contoured free end of the wand may also be "patterned", as for example by defining therein or thereon design or pattern-forming grooves or indentations or relief patterns or markings, or in any other appropriate way, to provide enhanced illumination of the free end by the light conducted along the wand from the LED. In this manner, the wand end may be caused to "glow" in a particular design or pattern, in a way that draws attention to the wand end, and/or to illuminate the application liquid retained on the configured wand end. As will be apparent, these particular implementations are especially, although not exclusively, useful where the liquid to be applied has at least some small degree of enhanced or added viscosity or is in a paste or gel-like form.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE CURRENTLY PREFERRED EMBODIMENTS

Figure 1:
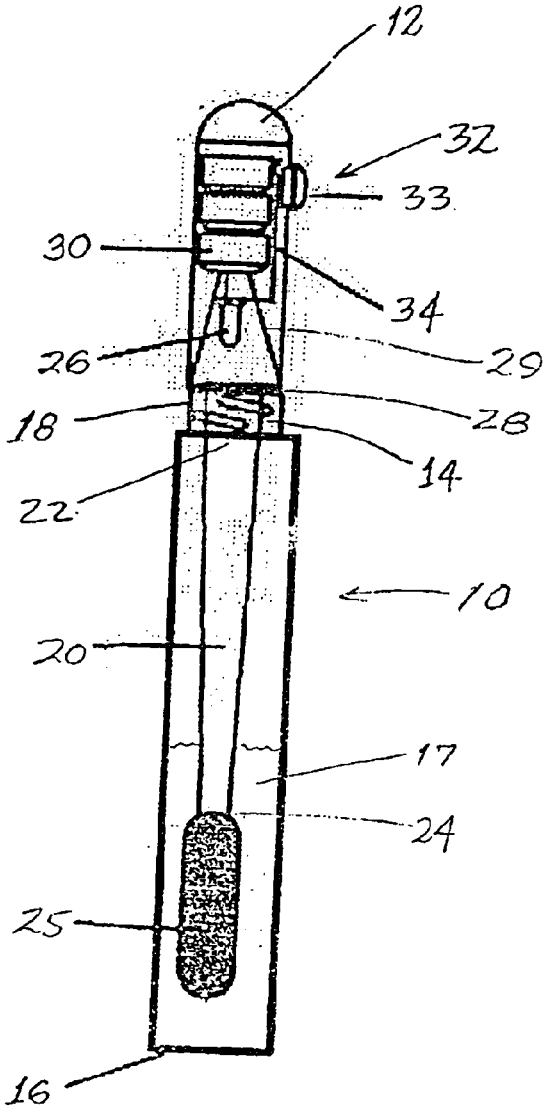
FIG. 1 is a schematic sectional view of an applicator according to the invention.

Referring specifically to FIG. 1, the applicator 10 includes a first housing part 12 having a threaded neck 14, and a second housing part 16 having an open end 18 which is internally threaded for engaging the threaded neck 14. A wand 20 of light transmissive or transmitting material has a fixed end 22 mounted in or proximate the neck 14, and projects outwardly to a free end 24 remote from the first housing part 12. The free end 24 carries a foam applicator pad 25 which retains liquid 17 contained in a reservoir provided in the second housing part 16, which is formed as an elongate vial or bottle.

A light source in the form of an LED 26 is mounted in the housing part 12 adjacent or clearly proximate to the fixed end 22 of wand 20, together with a collector plate 28, which may also be in the form of a lens, for focussing or gathering or directing light from the LED onto fixed end 22 of the wand. A reflector 29—shown in the drawing by way of example as a cone-shaped member—directs or focuses light from the LED toward the collector plate or lens 28. The collector plate 28 may alternatively be implemented, instead of the preferred lens, as a plate-like member formed integrally with or separately from the wand 20, and forms of the inventive application in which one or both of the collector plate and reflector are omitted are within the contemplation of the invention.

Wand 20 may be made of a light transmissive or translucent material and may be in the shape of an elongate cone.

The LED is powered by one or more button-type or watch or otherwise miniaturized batteries 30, and are connected in series with the LED via a user-actuable switch 32 which is accessible to the user on the exterior of first housing part 12. The applicator 10 may also include a circuit or other components connected to the LED, batteries and switch for controlling the activation of the LED in any desired manner, as for example to cause the LED to Intermittently emit light or to cease emitting after a predetermined time interval after switch activation.

Figure 2:
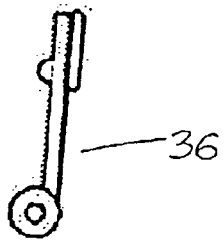
FIG. 2 is a side view of an alternative switch element for activating the LED.

In FIG. 1, the switch 32 is shown by way of example as a bent wire leg 34 of the LED to thereby define a spring-loaded return mechanism for a user-accessible switch button 33. Alternatively, the switch may be implemented as a separate electrically-conductive pivotable element 36, as shown in FIG. 2, that is disposed between the LED and the switch button, in any other suitable form to provide the disclosed functionality.

While there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. An applicator for applying a liquid to a surface, said applicator comprising:

a first housing part;

an elongated wand of light transmissive material having a fixed end mounted in said first housing part and projecting from said fixed end to a free end remote from said housing part, said wand including a light dispersing mechanism comprising at least one of: (i) a decreasing cross-sectional diameter as measured from the fixed end to the free end, (ii) a plurality of radial projections, (iii) a plurality of scoring marks, (iv) a fluorescing or phosphorescing or illumination-enhancing additive, and (v) a reflecting material or reflecting particles;

means for retaining a liquid on said free end of said wand; and an activatable light source mounted in said first housing part so that light emitted from the light source enters said fixed cad of said wand and is transmitted in and through said wand so as to illuminate at least a portion of said wand; and a second housing part which releasably mates with said first housing part to enclose said wand of light transmitting material within the first and second housing parts, said second housing part including a reservoir for containing a supply of the liquid; wherein the light dispersing mechanism is separable from the reservoir.

2. An applicator as set forth in claim 1, wherein said second housing part is made of a light transmissive material.

3. An applicator as set forth in claim 1, wherein said wand of light transmissive material is in the shape of an elongate cone.

4. An applicator as set forth in claim 1 wherein said light source comprises an LED.

5. An applicator as set forth in claim 1, further comprising means for directing light emitted by said light source onto the fixed end of said wand.

6. An applicator its set forth in claim 5, wherein said means for directing light comprises a lens.

7. An applicator as set forth in claim 5, wherein said means for directing light comprises a reflector.

8. An applicator as set forth in claim 1, wherein said wand of light transmissive material is translucent.

9. An applicator as set forth in claim 1, further comprising at least one button-type battery for powering said light source.

10. An applicator as set forth in claim 1, further comprising means for selectively activating said light source mounted in said first housing part.

11. An applicator as set forth in claim 1, wherein said means for retaining a liquid on said free end of said wand comprises a mass of absorbent material.

12. An applicator as set forth in claim 1, wherein said means for retaining a liquid on said free end of said wand comprises a substantially flat or contoured spatula formed integrally with said wand.

13. An applicator for applying a liquid to a surface, said applicator comprising:

a first housing part;

an elongated wand of light transmissive material having a fixed end mounted in said first housing part and projecting from said fixed end to a free end remote from said first housing part;

means for retaining a liquid on said free end of said wand;

a second housing part which releasably mates with said first housing part, said second housing part including a reservoir for containing a supply of the liquid; and an activatable light source mounted in said first housing part so that light emitted from the light source enters said fixed end of said wand and is transmitted in and through said wand so as to illuminate, from within said means for retaining a liquid on said free end of said wand, said retaining means such that said retaining means is visibly illuminated through said retaining means from said free end of the wand.

14. An applicator as set forth in claim 13 wherein said second housing part is made of a light transmissive material.

15. An applicator as set forth in claim 13, wherein said wand of light transmissive material is in the shape of an elongate cone.

16. An applicator as sat forth in claim 13, wherein said light source comprises an LED.

17. An applicator as set forth in claim 13, wherein said means for retaining a liquid on said free end of said wand comprises a mass of absorbent material.

18. An applicator as set forth in claim 13, wherein said means for retaining a liquid on said free end of said wand comprises a substantially flat or contoured spatula.

19. An applicator as set forth in claim 13, wherein said means for retaining a liquid is carried encircling on and about said free end of the wand for visible illumination of said retaining means from said free end through said retaining means.

* * * * *